US006912825B2

(12) United States Patent
Kothari

(10) Patent No.: US 6,912,825 B2
(45) Date of Patent: Jul. 5, 2005

(54) FLEXIBLE STAND-UP LIQUID POUCH WITH INTERNALIZED STRAW

(75) Inventor: Rahul A. Kothari, Mumbai (IN)

(73) Assignees: Francine Kirou, North York (CA); Jennifer Kirou, North York (CA)

( * ) Notice: Subject to any disclaimer, the term of this patent is extended or adjusted under 35 U.S.C. 154(b) by 0 days.

(21) Appl. No.: 10/233,300

(22) Filed: Aug. 29, 2002

(65) Prior Publication Data

US 2003/0221393 A1 Dec. 4, 2003

(30) Foreign Application Priority Data

May 28, 2002 (CA) ..... 2387692

(51) Int. Cl.[7] ..... B65B 61/20; B65D 77/00

(52) U.S. Cl. ..... 53/133.2; 53/133.3; 53/133.6; 53/133.8; 206/217

(58) Field of Search ..... 53/410; 206/217; 383/9, 38, 113

(56) References Cited

U.S. PATENT DOCUMENTS

| | | | | | |
|---|---|---|---|---|---|
| 2,849,321 | A | * | 8/1958 | Lhermitte et al. | 426/85 |
| 3,074,612 | A | * | 1/1963 | Schneider | 426/85 |
| 3,730,336 | A | * | 5/1973 | Feldman | 206/229 |
| 3,799,914 | A | * | 3/1974 | Schmit et al. | 426/85 |
| 4,762,124 | A | | 8/1988 | Kerch et al. | |
| 4,820,435 | A | | 4/1989 | Zafiroglu | |
| 5,782,344 | A | | 7/1998 | Edwards et al. | |
| 5,884,758 | A | | 3/1999 | Sigouin et al. | |
| 6,076,968 | A | * | 6/2000 | Smith et al. | 383/202 |
| 6,164,825 | A | * | 12/2000 | Larkin et al. | 383/104 |
| 6,220,756 | B1 | * | 4/2001 | Darmstadter | 383/207 |
| 6,375,001 | B1 | | 4/2002 | Beach | |
| 6,375,002 | B2 | | 4/2002 | Edwards | |
| 6,652,144 | B2 | * | 11/2003 | Stefandl | 383/38 |

FOREIGN PATENT DOCUMENTS

CA 2196108 7/1998

* cited by examiner

*Primary Examiner*—Rinaldi I. Rada
*Assistant Examiner*—Brian Nash
(74) *Attorney, Agent, or Firm*—Schmeiser, Olsen & Watts

(57) ABSTRACT

A flexible stand-up liquid pouch is formed from a sheet of foil film laminate material whereby opposed side walls of the material are folded together with sealed circumferential edges to form an enclosed chamber. A liquid is provided in the chamber, and the side walls of the sheet material which form the container have raised portions which, when sealed together, cooperatively form an internal straw restraining passage inside the container. The straw restraining passage communicates with the liquid chamber and a straw is held loosely captive inside the straw restraining passage and is axially displaceable therein. The straw restraining passage defines a reduced cross-sectional area of the chamber, and the pouch is manufactured with a weakened portion on an upper portion of the pouch, whereby the weakened portion can be torn by a user, thus enabling the internal straw to emerge, due to the buoyancy of the straw, from the interior of the pouch. In providing a sealed bottom edge to the liquid pouch, a bottom rim is formed, wherein the pouch can stand in an upright position on a horizontal surface upon the bottom rim.

24 Claims, 6 Drawing Sheets

FLEXIBLE STAND-UP LIQUID POUCH WITH INTERNALIZED STRAW

The present invention relates generally to a flexible stand-up liquid pouch having an internalized straw held captive in a restraining passage formed therein, and method of manufacturing same, wherein a weakened portion on an upper portion of the pouch is provided, whereby the weakened portion can be torn by a user, thus enabling the internalized straw to emerge, due to the buoyancy of the straw, from the interior of the pouch.

DESCRIPTION OF THE PRIOR ART

Conventional aluminium foil beverage containers often possess a round hole provided at a top side face, which is covered with a thin film of aluminium, and which can be pierced by a straw. In drinking the beverage in the container, a straw, which is usually attached on a side of the container for convenience, is pulled off the container and inserted through the hole. However, in such container arrangements the straw tends to completely sink inside the container, or, it can be difficult for the user to acquire the liquid product from the container, due to the straw being shorter than the height of the container.

It is also known to provide packaged liquid containers, such as that described in U.S. Pat. No. 3,730,336, wherein a flexible plastic bag contains a straw which floats freely within the bag, whereby liquid from the bag may be extracted by manipulating the bag to grasp the free-floating straw and push it through the bag wall from within, so that liquid can be acquired through the straw or forced from the bag through the straw by compression of the bag. However, there are disadvantages associated with such bags and one of these disadvantages is that it can be difficult to locate and grasp the free-floating straw by compressing the side walls of the bags, due to the volume of liquid and air contained within the bags. In an attempt to alleviate this problem a large air space is left within the bag so that the side walls can be collapsed with the liquid having sufficient space to be displaced inside the bag, however, this requires that a large quantity of air be provided and results in having to make the pouch much larger than the contained volume of liquid.

Another disadvantage of such flexible liquid containers is that in trying to grasp the free floating straw within the liquid of the bag, the straw can be bent in the process of trying to grasp it through the liquid, thereby weakening the rigidity of the straw and making it ineffective to puncture the bag.

SUMMARY OF THE INVENTION

Thus, a primary object of the present invention is to provide a flexible stand-up liquid pouch which can overcome the above mentioned disadvantages of prior art flexible liquid pouches. It is a further feature of the present invention to provide a foil film liquid pouch formed of sheet material which contains an internal straw restraining passage which communicates with the liquid chamber of the pouch and which retains an axially displaceable straw captive internally in the straw restraining passage, whereby a weakened portion of an upper surface of the pouch can be torn by a user, thus enabling the internal straw to emerge, due to the buoyancy of the straw, from the interior of the pouch.

Another object of the present invention is to provide a flexible stand-up beverage pouch having a sealed bottom edge to the liquid pouch, forming a bottom rim, wherein the pouch can stand in an upright position on a horizontal surface upon the bottom rim.

A further object of the present invention is to provide a novel method of forming a flexible standup liquid pouch with an internalized straw held captively restrained in a straw restraining passage internally of the pouch.

Accordingly, one aspect of the present invention provides a liquid pouch comprising a pair of opposed side walls formed from sheet material and having a sealed mutual top edge, bottom edges each sealed to a bottom portion, and opposed sealed mutual side edges to form an enclosed compartment capable of containing a liquid product; a straw-restraining passage formed internally of said compartment between the opposed side walls thereof, the straw-restraining passage defining a reduced cross-sectional area of the enclosed compartment, said straw-restraining passage being immediately adjacent a weakened portion of one of the sealed side edges; and a straw held loosely captive in the straw-restraining passage but axially displaceable therein, whereby the weakened portion can be torn by a user, thus enabling the straw to emerge, due to buoyancy of the straw, from the enclosed compartment.

Another particular aspect of the present invention provides a liquid pouch comprising a pair of opposed side walls formed from sheet material and having a sealed mutual top edge, bottom edges each sealed to a bottom portion, and opposed sealed mutual side edges to form an enclosed compartment capable of containing a liquid product, a flexible gusset being provided at an end of the enclosed compartment between the opposed side walls, wherein, in sealing the bottom edges of the pouch to a bottom portion, a bottom rim is formed, wherein the pouch can stand in an upright position on a horizontal surface upon the bottom rim, whereby the flexible gusset is upwardly recessed from and contained within a perimeter of said bottom rim; a straw-restraining passage formed internally of said enclosed compartment between said opposed side walls thereof, the straw-restraining passage defining a reduced cross-sectional area of said enclosed compartment, said straw-restraining passage being immediately adjacent to a weakened portion of one of the sealed side edges; and a straw held loosely captive in said straw-restraining passage but axially displaceable therein, whereby the weakened portion can be torn by a user, thus enabling the straw to emerge, due to buoyancy of the straw, from the enclosed compartment.

Another particular aspect of the present invention provides a method for dispensing contents from a liquid pouch, the method comprising the steps of tearing the weakened portion provided on the upper portion of one of the sealed side edges of the pouch, to thereby expose the straw; enabling the straw to emerge, due to a buoyancy of the straw, from the interior of the pouch; and removing contents from the compartment through the straw.

A still further aspect of the present invention provides a method for manufacturing a liquid pouch having an internalized straw positioned within an enclosed compartment of the pouch, said method comprising the steps of folding and sealing together edges of a pair of opposed side walls formed from sheet material to form a pouch having an open-top end, placing raised portions upon the sheet material of each of said opposed side walls, wherein each of the raised portions has a slightly higher elevation than a substantial portion of a remainder of said sheet material, whereby when the edges of the pair of opposed side walls are sealed together so as to form the pouch having the open top end, the raised portions of each opposed side wall contact each other and are cooperatively placed in alignment so as to define a straw-restraining passage within the enclosed compartment of the pouch which communicates with a liquid product in the enclosed compartment; simultaneously placing a straw, in a cross-directional angle, into the open-top end of the pouch, whereby the straw is retained in an axially displaceable position within the straw-restraining passage; inserting the liquid product in the pouch, so as to form a liquid-filled pouch; stretching the liquid-filled pouch, whereby air is removed from the enclosed compartment of the liquid-filled pouch; sealing the open top end of the liquid-filled pouch to form a sealed pouch with said liquid product and said straw held within the enclosed compartment of the sealed pouch; and providing a weakened portion on an outer surface of the sealed liquid pouch; whereby, when the weakened portion is torn by a user, the straw emerges from the enclosed compartment of the sealed liquid pouch, due to buoyancy of the straw, whereby the liquid can be extracted from said sealed liquid pouch.

It should be noted that, in forming the pouch, the sheet material which is folded together so as to form the pouch is advantageously a foil laminate sheet material. In a preferred embodiment, this sheet material could, for example, be non-transparent in at least a substantial portion of the pouch. The enclosed compartment containing the liquid product in the interior of the pouch, which is formed when the sheet material is folded and sealed, is substantially positioned between the opposed side walls and the flexible gusset. The sealed side edges of the pouch, when cut from the sheet material formed therefrom, are also preferably curved to resemble an hourglass shape.

The weakened portion of the pouch, can comprise, for example, a "V" shaped indented notch cut into the upper portion of one of the sealed side edges of the pouch. This weakened portion should preferably be located near a top end of the pouch, adjacent to the internal straw restraining passage, whereby a user would tear the weakened portion of the pouch diagonally upwardly to expose the internal straw restraining passage, which permits the internalized straw to emerge, due to the buoyancy of the straw, from the interior of the pouch. Cutting or forming such a weakened portion on the pouch can occur at any stage of the manufacturing process, but preferably is affected after the sheet material forming the pouch has been sealed together.

In manufacturing the pouch, the sealing means which define the internal straw restraining passage formed within the interior enclosed compartment of the pouch comprise raised portions advantageously placed on the sheet material. These raised portions are formed upon the sheet material of each of the opposed side walls of sheet material, and when these opposed side walls are sealed together to form the enclosed compartment, the raised portions of each opposing side wall contact each other and are cooperatively placed in alignment so as to define the straw restraining passage within the interior of the pouch. The raised portions, which can be merely an extra layer of sheet material or, for example, a placement of fast drying adhesive or silicone placed on the sheet material, have a slightly higher elevation than a substantial portion of the remainder of the sheet material, and are disposed substantially parallel to one of the sealed side edges of the pouch, and form the straw restraining passage, which is shorter than the length of the sealed side edges. The length of the formed straw restraining passage extends from the sealed top edge and terminates preferably no farther than a mid-length area of the pouch. Thus, when the sheet material is folded to form the pouch, the raised portions of each opposed side wall will come into contact with other first when the sheet material is folded, and define the straw restraining passage on the interior of the pouch. The remainder of the sheet material forming each opposed side wall will, when sealed at the edges thereof, form the enclosed compartment of the pouch, but will not be in contact with the other opposed side wall within the enclosed compartment.

In forming the sealed bottom edge of the pouch, the sheet material forming the pouch is first sealed together horizontally across a bottom portion of the pouch, forming a bottom seal line located beneath the enclosed interior compartment of the pouch. The lower side edges of the pouch, which lie beneath the bottom seal line, are then sealed on either side of the pouch. Once the lower side edges of the pouch are sealed together, a bottom rim of the pouch is formed, wherein the pouch can stand in an upright position on a horizontal surface upon the bottom rim. In doing so, the flexible gusset is then upwardly recessed from and contained within a perimeter of the bottom rim.

BRIEF DESCRIPTION OF THE DRAWINGS

Embodiments of the present invention will-be further described with reference to the accompanying drawings, in which.

DETAILED DESCRIPTION OF THE DRAWINGS

Figure 1:
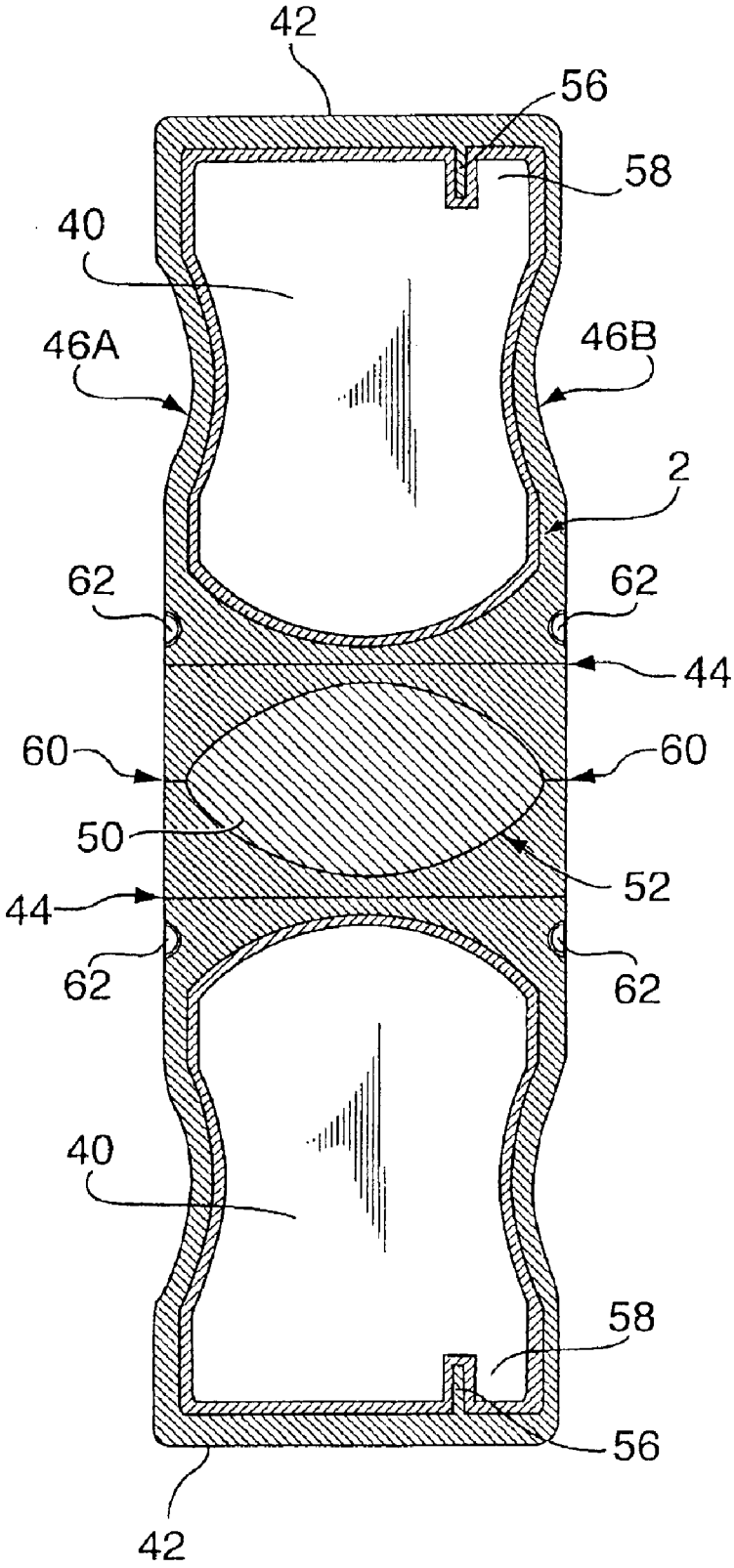
FIG. 1 illustrates a top view of an unfolded section of sheet material which can be folded so as to form the liquid pouch of the present invention.

Referring to FIG. 1, there is provided a top view of an unfolded section of sheet material (2) of which the liquid pouch is formed, when the sheet material is later folded. At opposite ends of the sheet material (2) are each of the opposed side walls (40) of the pouch. In forming the pouch, the opposing side walls (40) are folded together so as to form a pouch therebetween, the sheet material (2) of the pouch then being sealed together, wherein the top edges (42) of each opposed side wall portion (40) are sealed together so as to form the top edge (42) of the sealed pouch shown in FIG. 2. With reference again to FIG. 1, the bottom edges (44) of each opposed side wall portion (40) are also sealed together, wherein a seal line is placed horizontally across the bottom of the pouch, so as to seal the sheet material of each opposed side wall portion (40) together at the bottom of the pouch. At a top end of the pouch (36), an internal straw restraining passage (58) is provided. This internal straw restraining passage (58) is formed by providing a raised portion (56) on each opposed side wall (40) of the sheet material (2), the raised portion having a slightly higher elevation than a substantial portion of a remainder of said sheet material (2). Since the raised portion (56) is formed upon each opposed side wall (40), when the opposed side walls (40) are sealed together in forming the pouch (36), the raised portions (56) of each opposing side wall (40) are cooperatively placed in axial alignment with one another so as to define the straw restraining passage (58) within the internal compartment (54) of the pouch. The raised portions (56) on the sheet material, when sealed together in forming the pouch (36) form the straw restraining passage (58), are spaced a predetermined distance from the sealed side edge of the pouch (36), and are disposed substantially parallel thereto. The raised portions can, for example, be extra sheet material fastened thereon so as to provide the raised area, or can be a fast drying silicone or adhesive that creates a raised area. It can be seen that the internal straw restraining passage (58) defines a reduced cross-sectional area within the internal compartment (54) of the pouch (36).

Figure 2:
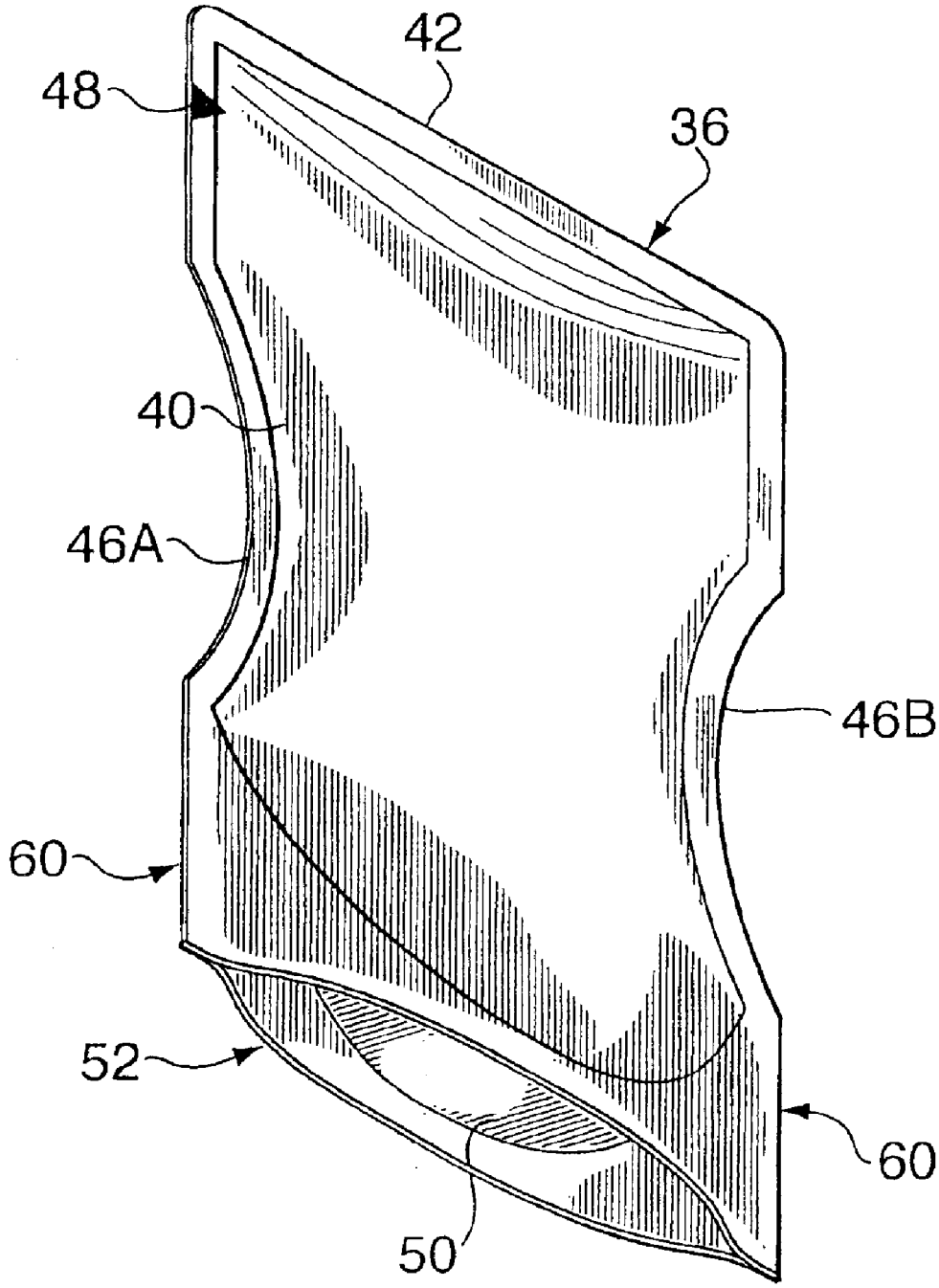
FIG. 2 is a lower perspective view of the flexible standup liquid pouch of the present invention.
Figure 3:
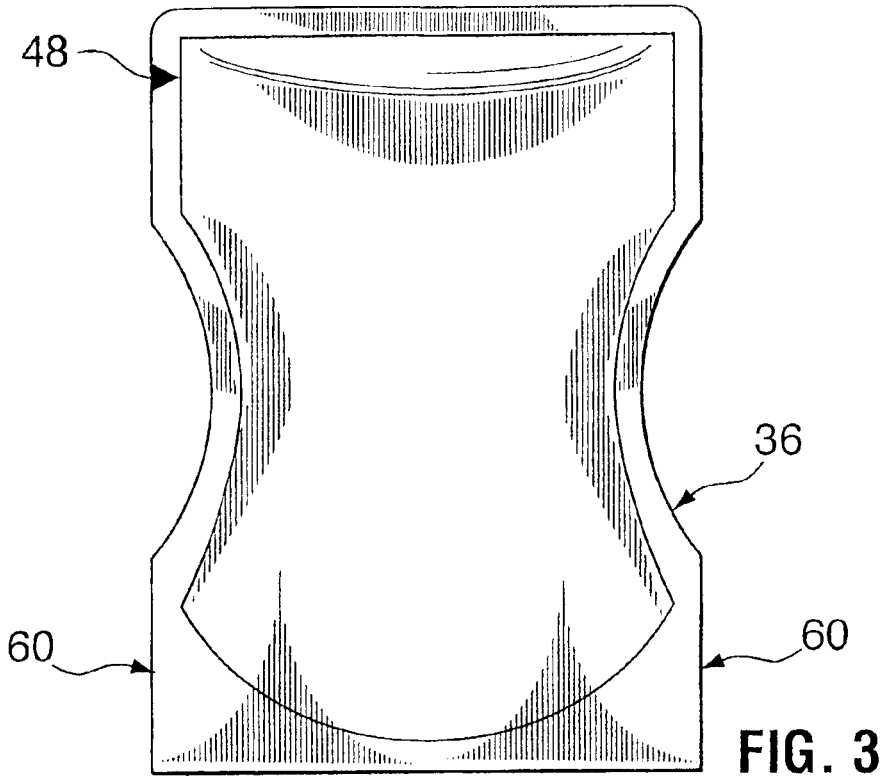
FIG. 3 is a front view thereof.
Figure 4:
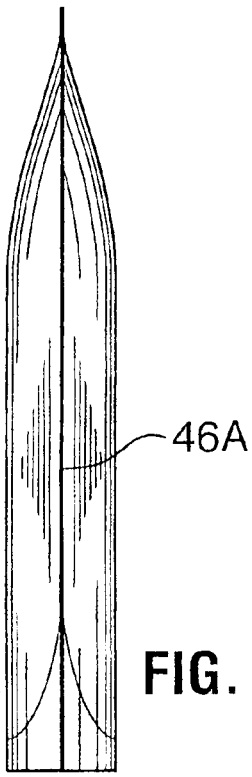
FIG. 4 is a left side view thereof, illustrating the flexible standup liquid pouch of the present invention in a sealed state and being partially expanded when filled with liquid.
Figure 5:
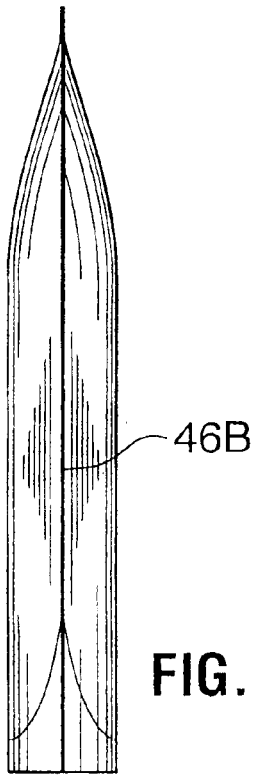
FIG. 5 is a right side view thereof, illustrating the flexible standup liquid pouch of the present invention being partially expanded when filled with liquid.
Figure 6:
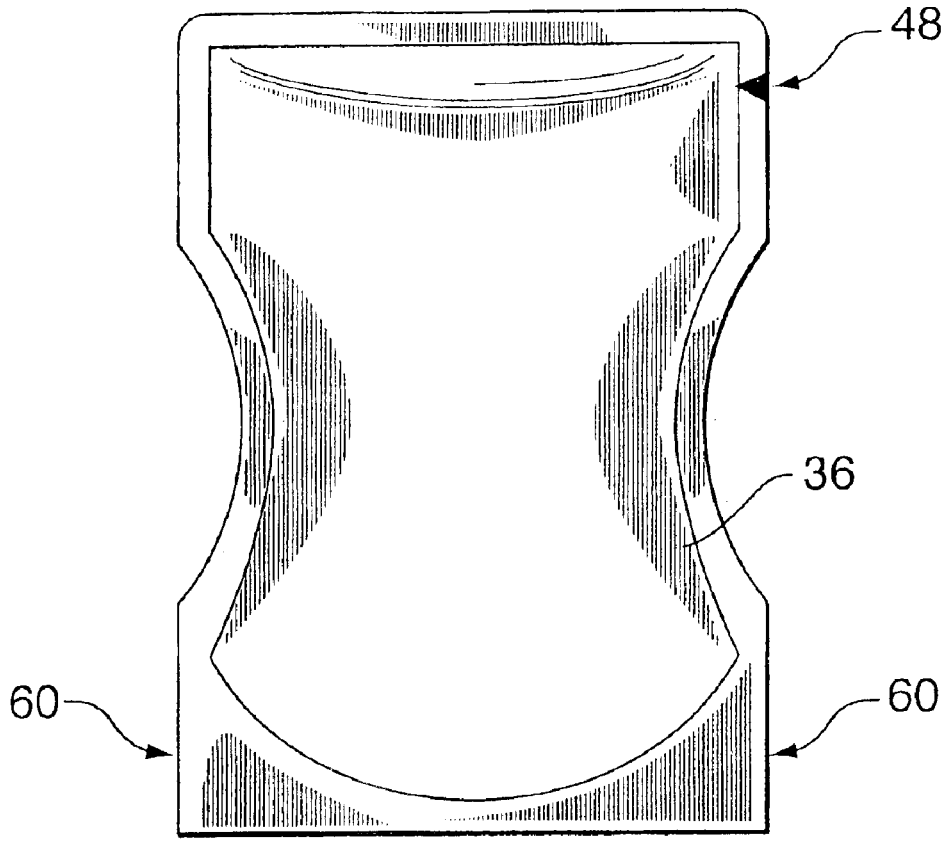
FIG. 6 is a rear view thereof.
Figure 7:
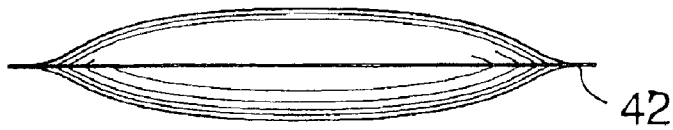
FIG. 7 is a top view thereof.
Figure 8:
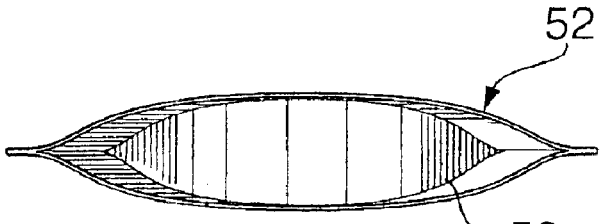
FIG. 8 is a bottom view thereof.
Figure 9:
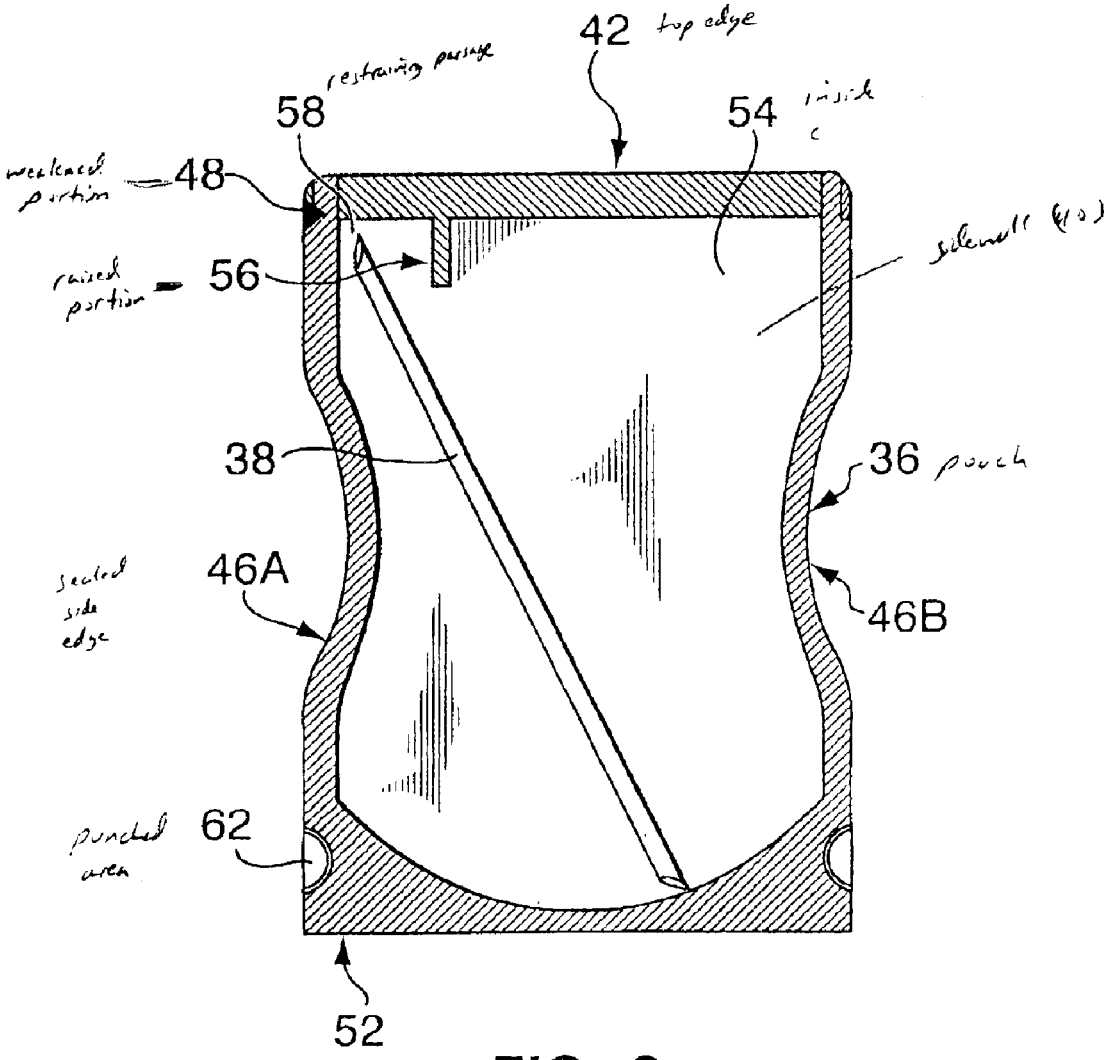
FIG. 9 is a side view broken away of the liquid pouch of the present invention illustrated in FIGS. 2 to 8, and which illustrates the internal straw restraining passage and internalized straw contained within the interior of the pouch.

Opposed sealed side edges (46A,46B) of each of the opposed side wall portions are also sealed in order to form the pouch, and thus form an enclosed compartment (54), the enclosed compartment (54) of the pouch being shown in FIG. 9. In forming the pouch, when the sheet material (2) is folded together to form the enclosed compartment (54) of the pouch therebetween, a flexible gusset (50) is formed at a bottom portion of the pouch. The bottom side edges of the pouch surrounding the flexible gusset (50), on either side of the pouch, are then sealed again, and these lower sealed edges (60) of the pouch contour around the elliptical curved shape of the flexible gusset (50) so as to provide a bottom rim (52) for the pouch, wherein the pouch can stand in an upright position on a horizontal surface upon the bottom rim (52). FIG. 2 provides a clear example of how sealing the lower sealed edges (60) of the pouch creates the bottom rim (52). By virtue of sealing the lower sealed edges (60) of the pouch, the flexible gusset (50) is then also upwardly recessed from and contained within a perimeter of the bottom rim (52). A hole punching assembly (4), which is hereinafter described with reference to FIG. 10, punches two holes of equal diameter on the sheet material (2) at a distance which establishes the pouch width. These punched areas (62) are located on either side of each of the opposed side walls (40), as can be seen in FIG. 1.

Illustrated in FIGS. 2 to 8 is a diagrammatic representation of a flexible stand-up liquid pouch according to the present invention. Referring to FIGS. 2 to 8, there is shown generally the liquid pouch of the present invention, wherein it can be seen that the pouch (36) is shown in a sealed state, after the opposing side walls (40) of sheet material have been sealed together, between which the pouch (36) is defined, the pouch having a sealed top edge (42). The pouch (36), when folded together, also defines a flexible bottom gusset (50) at one end of the pouch (36), and preferably the bottom end of the pouch. The side edges of the pouch (46A, 46B), when sealed together, are curved to resemble and provide the pouch with an hourglass shape. An upper side edge of the pouch (36) contains a weakened portion (48), which can, for example, consist of a "V" shaped notch being cut or indented into an upper side edge (46A) of the pouch. This weakened portion (48) of the pouch (36) can be torn in an upwardly diagonal direction by a user so as to provide an opening in the pouch which will release an internalized straw (which can be seen with reference to the cut away view of the pouch as seen in FIG. 9) from within the interior of the pouch (36). The lower sealed side edges (60) of the pouch (36) are sealed together along bottom side edges of the pouch (36), thus forming a bottom rim (52) at a base of the pouch (36). This bottom rim (52) may be somewhat circular in shape, as, for example, when the pouch is filled with liquid, or can be somewhat elliptical in shape if the pouch (36) has been emptied of some of its contents.

Referring to FIG. 9, a cutaway view of the pouch (36) is illustrated, which in this view shows one of the side walls of the pouch (40). As noted previously, the side walls (40) of the pouch, when folded together and sealed, form and define the pouch (36) illustrated in FIGS. 1 to 7. Inside the pouch (36) is an internalized straw (38), which is inserted, during manufacturing of the pouch (36), in a cross-directional angle within the internal compartment (54) of the pouch (36). At a top end of the pouch (36), an internal straw restraining passage (58) is provided. With reference again to FIG. 1, this internal straw restraining passage (58) is formed by providing a raised portion (56) on each opposed side wall (40) of the sheet material (2), the raised portion having a slightly higher elevation than a substantial portion of a remainder of said sheet material (2). Since the raised portion (56) is formed upon each opposed side wall (40), when the opposed side walls (40) are sealed together in forming the pouch (36), the raised portions (56) of each opposing side wall (40) are cooperatively placed in axial alignment with one another so as to define the straw restraining passage (58) within the internal compartment (54) of the pouch. The raised portions (56) on the sheet material, when sealed together in forming the pouch (36) form the straw restraining passage (58), are spaced a predetermined distance from the sealed side edge of the pouch (36), and are disposed substantially parallel thereto. It can be seen that the internal straw restraining passage (58) defines a reduced cross-sectional area within the internal compartment (54) of the pouch (36). This internal straw restraining passage (58) prevents the straw from free-floating within the internal compartment (54) of the pouch, by virtue of the fact that an upper end of the straw (38) is restrained from lateral movement within the internal compartment (54) of the pouch by the raised portions (56) which define the straw restraining passage (58), but the straw (38) remains loosely retained within the straw restraining passage (58) in order to permit the straw (38) to be released and to move axially therein. Accordingly, a weakened portion (48), which, for example, can be in the form of a "V" notch cut into the sides of the pouch, is provided on an upper portion of one of the sides of the pouch (36), whereby the weakened portion (48) can be torn by a user, thus enabling the straw (38) to emerge, due to a buoyancy of the straw (38), from an interior of the pouch, to extract a liquid product therefrom. Thus, because the top portion of the straw (38) is restrained within the internal straw restraining passage (58), the straw-is always at a predetermined position.

Figure 10:
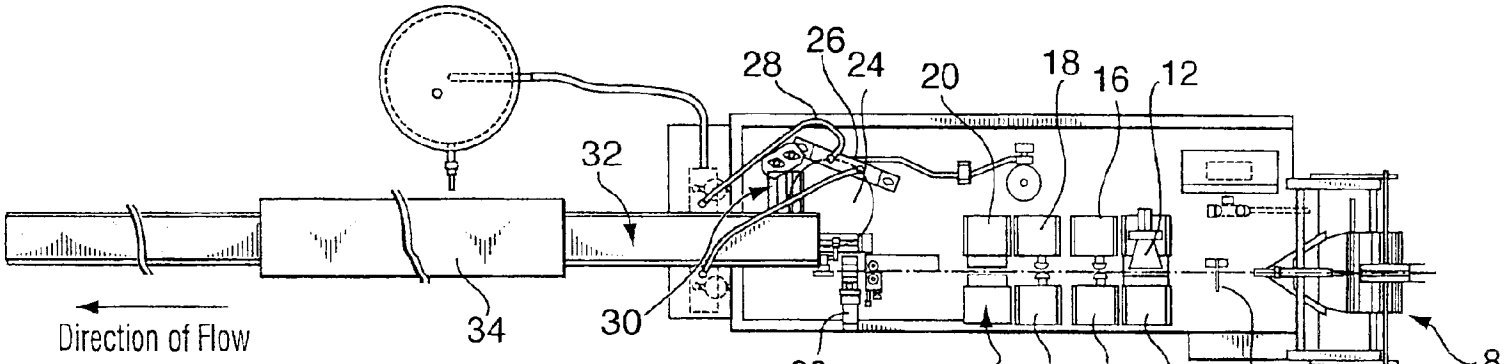
FIG. 10 is a top view which illustrates the assembly process involved in manufacturing the liquid pouch of the present invention, showing the various stations through which the pouch is passed.
Figure 11:
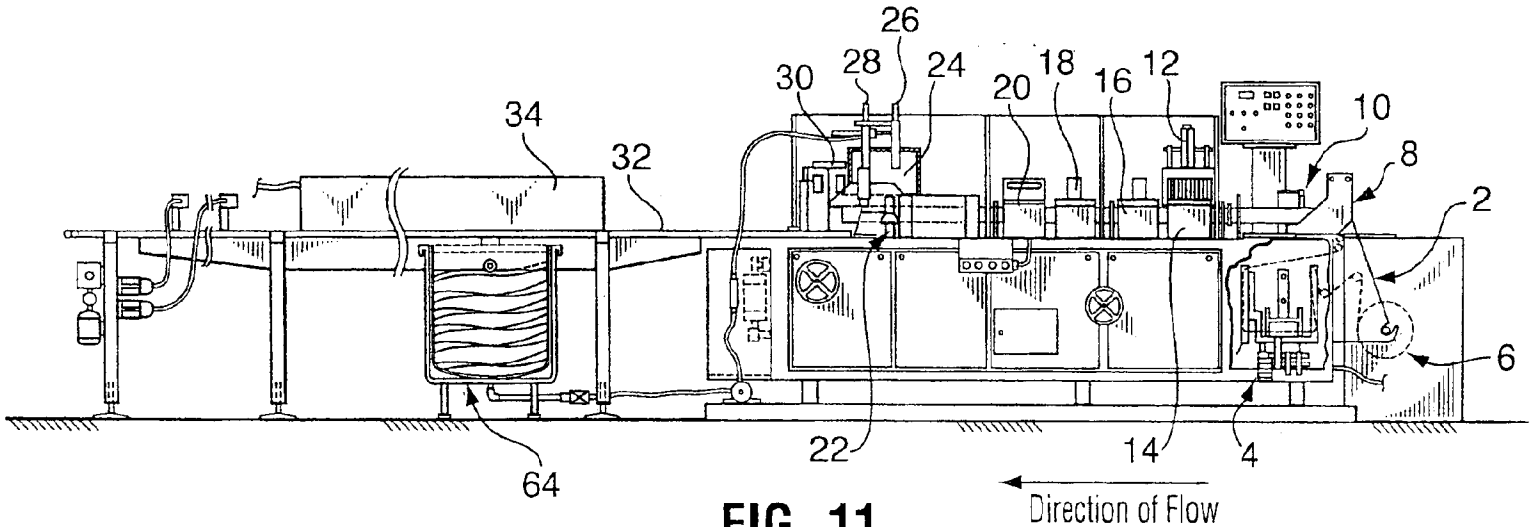
FIG. 11 is a side view of the assembly process illustrated in FIG. 10.

With reference now to FIGS. 10 and 11, there will now be described a method for fabricating the liquid pouch of the present invention, which features an internalized straw. Referring to FIG. 10, in the fabrication process of the pouch sheet material (2) is drawn, by means of a roller or rollers (6), through a hole punching assembly (4), which punches two holes of equal diameter on the sheet material (2) at a distance which establishes the pouch width. The punched holes establishing the pouch width on the sheet material can be noted with reference to FIG. 1, wherein it can be seen that each opposed side wall (40) of sheet material (2) has a punched area (62) located on either side of each of the opposed side walls (40). The punched sheet material (2) is then passed, by means of a conveyor belt (32) through a plough and gusset former (8), wherein the sheet material (2) is folded to form the pouch, and, in so doing, also forms the flexible gusset (50) at the bottom of the pouch. A coding unit (10) can also be used to place, for example, a manufacturer's code, such as a bar code, on the pouch.

The vertical sides of the sheet material (2), which have been folded to form the pouch, are then sealed twice with heat transferring sealing jaws (16), so as to define a pouch having an open top end. Straws are placed in a straw placement assembly (12) containing, for example, a hopper, wherein each individual straw is picked up by a vacuum shoe, and transferred above the open top end of the folded pouch. A pneumatic pusher of the straw placement assembly (12) pushes the straws inside the top end of the pouch at a cross-directional angle. As previously noted, the internal straw (38), at its uppermost end, is restrictively held in a diagonal position within the straw restraining passage (58) in the interior of the pouch (36) by the raised portions (56) extending partially downwards into the interior of the pouch, on each of the side walls of the container. By placing the straws inside the pouch at a cross directional angle, an upper portion of the straw is held within the straw restraining passage formed when the raised portions (56) of the sheet material are folded and sealed together when forming the pouch.

As the pouch is passed through the formation process, a small portion of an upper end of the top of the pouch, where the straw was inserted, is then sealed by vertical sealing means (18) so that the straw does not emerge during the filling operation, when liquid is to be inserted into the remaining unsealed top end of the pouch. A bottom sealing jaw (20) seals the lower edges of the pouch and gives the pouch a curved shape on the bottom, forming a bottom rim, to enable the pouch (36) to stand by themselves on a horizontal surface. The folded sheet material, forming the pouches, is then cut by means of a punching assembly (22), wherein individual pouches are formed, and which also cuts or forms the weakened portion of the upper side edge of the pouch which a user will later tear to remove the internalized straw from the interior of the pouch. The cut pouch, while being held by a gripper assembly (24), is then pulled apart by a vacuum suction and helped to open with a jet of air from above on the gripper assembly (24). Two sensors contained on the gripper assembly (24) determine if the pouch is open adequately, and if not, the sensors issue a signal to the filling system to stop.

The first filling nozzle (26) fills approximately 60% of the volume of the interior compartment of each pouch. A second filling nozzle (28) then fills the remaining 40% of the volume interior compartment of the pouch to be filled. The liquid filled pouches are then stretched to remove air from inside the pouch, whereby the remaining portion of the top end of the liquid filled pouch is sealed, through heat transfer, by top sealing means (30) and discharged on a conveyor belt (32). As the liquid product inserted into the pouch can reach temperatures of 180 degrees during the filling process, so as to sterilize the liquid product before placement into the pouch, the conveyor belt (32), then passes the filled, sealed liquid pouch through a cooling chamber (34), whereby water is sprayed over the outer surface of the pouch in order to cool it. As can be seen with reference to FIG. 11, the underside of the cooling chamber can contain a conventional drainage system (64), which removes water sprayed in the cooling chamber during the cooling process, and which can recycle and recirculate the water collected at the bottom of the cooling chamber, in order to facilitate this recirculated water being re-used by the cooling chamber to spray additional pouches passing through the cooling process in the cooling chamber. It is also possible, where the corners of the sheet material comprise straight edges, to have the punching assembly (22) cut the corners of the sheet material forming the pouch, so as to form rounded upper corners of the pouch.

The foregoing are exemplary embodiments of the present invention and a person skilled in the art would appreciate that modifications to these embodiments may be made without departing from the scope and spirit of the invention.

I claim:

1. A liquid pouch comprising:

a pair of opposed side walls formed from sheet material and having a sealed mutual top edge, bottom edges each sealed to a bottom portion, and opposed sealed mutual side edges to form an enclosed compartment capable of containing a liquid product;

a straw-restraining passage formed internally of said compartment between the opposed side walls thereof, the straw-restraining passage defining a reduced cross-sectional area of the enclosed compartment, said straw-restraining passage being immediately adjacent a weakened portion of one of the sealed side edges and disposed substantially parallel to said one of said sealed side edges of said pouch, wherein the straw-restraining passage extends from said sealed mutual top edge and terminates a mid-length area of said pouch, said straw-restraining passage being shorter than said sealed side edges; and a straw held loosely captive in the straw-restraining passage but axially displaceable therein, whereby the weakened portion can be torn by a user, thus enabling the straw to emerge, due to buoyancy of the straw, from the enclosed compartment.

2. The flexible pouch according to claim 1, wherein, in sealing the bottom edges of the pouch to a bottom portion, a bottom rim is formed, wherein the pouch can stand in an upright position on a horizontal surface upon the bottom rim.

3. The flexible pouch according to claim 2, wherein a flexible gusset is provided at an end of the enclosed compartment between the opposed side walls, the flexible gusset being upwardly recessed from and contained within a perimeter of the bottom rim.

4. The flexible pouch according to claim 3, wherein the enclosed compartment is formed substantially between the opposed side walls, and the flexible gusset.

5. The pouch according to claim 1, wherein the weakened portion is a "V" shaped indented notch formed on the upper portion of one of the sealed side edges of the pouch, and at a top end of said straw-restraining passage.

6. The pouch according to claim 1, wherein the straw restraining passage is comprised by a raised portion of the sheet material having a slightly higher elevation than a substantial portion of a remainder of said sheet material, the raised portion being formed upon the sheet material of each of said opposed side walls, whereby when the opposed side walls are sealed together so as to form the enclosed compartment, the raised portion of each opposing side wall contacts each other and are cooperatively placed in alignment so as to define the straw-restraining passage within the enclosed compartment.

7. The pouch according to claim 1, wherein said sheet material is a foil laminate sheet material.

8. The pouch according to claim 7, wherein said foil laminate sheet material is a non-transparent sheet material in at least a substantial portion of said pouch.

9. Tho pouch according to claim 1, wherein the sealed side edges of the pouch are curved to resemble an hourglass shape.

10. The pouch according to claim 1, wherein a diameter of the weakened portion of the pouch is greater than a diameter of the straw.

11. The pouch according to claim 1, wherein the straw in said straw-restraining passage lies in a cross-directional angle, whereby a top portion of the straw lies in the straw-restraining passage and a lower portion of the straw lies in the enclosed compartment beyond the straw-restraining passage.

12. The pouch according to claim 1, whereby the weakened portion is provided on an upper portion of one of the sealed side edges of the pouch.

13. Apparatus comprising:

a pair of opposed side walls formed from sheet material and having a sealed mutual top edge, bottom edges, and side edges to form an enclosed compartment, capable of containing a liquid product;

a straw-restraining passage within said compartment between the pair of opposed side walls thereof, said straw-restraining passage defined by a raised portion having a first side and an opposite second side extending toward the bottom edges, wherein the first side of said raised portion defines the straw-restraining passage and the opposite second side is exposed to the compartment, said straw-restraining passage being immediately adjacent a weakened portion of one of the sealed side edges and disposed substantially parallel to said one of said sealed side edges of said pouch, therein the straw-restraining passage extends from said sealed mutual top edge and terminates in a mid-length area of said pouch, said straw-restraining passage being shorter than said sealed side edges; and a straw held loosely captive in the straw-restraining passage but axially displaceable therein, whereby the weakened portion can be torn by a user, thus enabling the straw to emerge, due to buoyancy of the straw, from the enclosed compartment.

14. The flexible pouch according to claim 13, wherein, in sealing the bottom edges of the pouch to a bottom portion, a bottom rim is formed, wherein the pouch can stand in an upright position on a horizontal surface upon the bottom rim.

15. The flexible pouch according to claim 14, wherein a flexible gusset is provided at an end of the enclosed compartment between the opposed side walls, the flexible gusset being upwardly recessed from and contained within a perimeter of the bottom rim.

16. The flexible pouch according to claim 15 wherein the enclosed compartment is formed substantially between the opposed side walls, and the flexible gusset.

17. The pouch according to claim 13, wherein the weakened portion is a "V" shaped indented notch formed on the upper portion of one of the sealed side edges of the pouch, and at a top end of said straw-restraining passage.

18. The pouch according to claim 13 wherein the raised portion includes a slightly higher elevation than a substantial portion of a remainder of said sheet material, the raised portion being formed upon the sheet material of each of said opposed side walls, whereby when the opposed side walls are sealed together so as to form the enclosed compartment, the raised portion of each opposing side wall contacts each other and are cooperatively placed in alignment so as to define the straw-restraining passage within the enclosed compartment.

19. The pouch according to claim 13, wherein said sheet material is a foil laminate sheet material.

20. The pouch according to claim 19, wherein said foil laminate sheet material is a non-transparent sheet material in at least a substantial portion of said pouch.

21. The pouch according to claim 13, wherein the sealed side edges of the pouch are curved to resemble an hourglass shape.

22. The pouch according to claim 13, wherein a diameter of the weakened portion of the pouch is greater than a diameter of the straw.

23. The pouch according to claim 13, wherein the straw in said straw-restraining passage lies in a cross-directional angle, whereby a top portion of the straw lies in the straw-restraining passage and a lower portion of the straw lies in the enclosed compartment beyond the straw-restraining passage.

24. The pouch according to claim 13, whereby the weakened portion is provided on upper portion of one of the sealed side edges of the pouch.

* * * * *